United States Patent [19]

Ames

[11] 4,132,097

[45] Jan. 2, 1979

[54] METHOD FOR FORMING COLLARED HOLES

[75] Inventor: Ward A. Ames, Danville, Ill.

[73] Assignee: Tridan Tool & Machine, Inc., Danville, Ill.

[21] Appl. No.: 848,328

[22] Filed: Nov. 3, 1977

[51] Int. Cl.[2] ..... B21D 51/38

[52] U.S. Cl. ..... 72/71; 72/325; 113/116 UT

[58] Field of Search ..... 72/71, 325, 326; 29/157 T; 113/116 UT

[56] References Cited

U.S. PATENT DOCUMENTS

| | | | |
|---|---|---|---|
| 2,991,551 | 7/1961 | Fogle et al. | 72/71 |
| 3,429,171 | 2/1969 | Feher | 72/325 |

FOREIGN PATENT DOCUMENTS

| | | | |
|---|---|---|---|
| 1455276 | 11/1976 | United Kingdom | 72/325 |

*Primary Examiner*—Lowell A. Larson

*Attorney, Agent, or Firm*—Woodard, Weikart, Emhardt & Naughton

[57] ABSTRACT

A method for forming collared holes in a workpiece. The tool has a drill formed at one end thereof for forming a hole in the workpiece. Immediately adjacent and contiguous to the drill is a tapered configured portion which is extendable into the hole formed by the drill. Rotation of the tool causes a collar to form around the hole as the tapered portion of the tool is rotated and forced into the hole. The tool has a constant diametered rod configured portion to straighten and polish the inside surface of the collar formed around the hole in the workpiece. The method of forming the collared hole in a workpiece includes the steps of forming the hole in the workpiece, inserting the tapered tool into the hole so as to contact the tapered tool against the circumference of the hole. The tool is then rotated and the tapered portion is forced further through the hole so as to form the collar integral with the workpiece and surrounding the hole while protruding from opposite sides of the workpiece.

3 Claims, 12 Drawing Figures

METHOD FOR FORMING COLLARED HOLES

BACKGROUND OF THE INVENTION

1. Field of the Invention

This invention is in the field of tools for forming collared holes.

2. Description of the Prior Art

Heat transfer coils include a plurality of coolant tubes typically joined together by brazed joints. A header coolant tube is typically provided with a plurality of openings which lead into a plurality of smaller diameter coolant tubes. It is customary to provide a collar extending around each of the openings in the header conduit with the smaller diameter coolant tubes then extending into each opening being brazed to the collars. It is customary to also braze the collars to the larger diameter header tube. The brazed joint between the collar and the header may eventually fail resulting in a leak through which the coolant may escape. The collars must be separately produced and installed in the header conduit adding considerably to the cost of manufacturing the heat transfer coils.

Disclosed herein is a method and tool for producing a collar integral with the workpiece eliminating the prior requirement or step of brazing the collar to the workpiece. The integral connection between the collar and workpiece eliminates the possibility of leakage between the collar and the workpiece. The collar formed with the tool and method disclosed herein protrudes not only externally from the header tube but also protrudes into the header tube allowing additional area of contact between the collar and the coolant tube inserted therein and brazed to the collar. Another prior method of producing a collared hole includes forming a hole within the workpiece and then projecting a tool through the hole with the tool having expandable flutes or arms which when pulled outwardly through the hole stretches and deforms the material surrounding the hole so as to form an outwardly projecting collar integral with the workpiece.

SUMMARY OF THE INVENTION

One embodiment of the present invention is a method of forming a collared hole comprising the steps of forming a hole in a workpiece, inserting a tapered tool into the hole wherein the tool is of sufficient size and taper to interferingly engage the hole, contacting the tapered tool against the workpiece around the circumference of the hole, rotating the tapered tool during the contacting step, forcing the tapered tool further through the hole during the rotating step forming a collar integral with the workpiece around the hole, and withdrawing the tapered tool from the hole.

Another embodiment of the present invention is a tool for forming a collar around a hole in a workpiece comprising a main body having a longitudinal axis of rotation and a mounting end configured to be secured for rotation of the main body about the axis, the main body including a tapered configuration portion with a distal end portion and a proximal end portion, the axis extending from the proximal end portion to the distal end portion through the tapered configured portion, the tapered configured portion having an outer circumferentially extending collar forming surface with the surface located closer to the axis at the distal end portion than at the proximal end portion with the distal end portion fitting into the hole as the tapered configured portion rotates and is forced into the hole forming a collar around the hole protruding on opposite sides of the workpiece.

Yet a further embodiment of the present invention is a collared workpiece comprising a main body of metal of a certain thickness having a first side and an opposite second side, the main body having a hole extending therethrough and a collar integrally joined thereto completely surrounding the hole, the collar projecting through the thickness and through the first side and through the second opposite side, and wherein the workpiece is a conduit and the collar projects inside and outside the workpiece which has a longitudinally extending center axis, the collar has a longitudinally extending center axis located off center relative to the axis of the conduit.

It is an object of the present invention to provide a method and tool for forming a collared hole in a workpiece with the collar being integral with the workpiece.

Yet another object of the present invention is to provide a tool and method for forming a collar integral with a workpiece with the collar surrounding a hole in the workpiece and projecting from the opposite sides of the workpiece.

Related objects and advantages of the present invention will be apparent from the following description.

DESCRIPTION OF THE PREFERRED EMBODIMENTS

Figure 1:
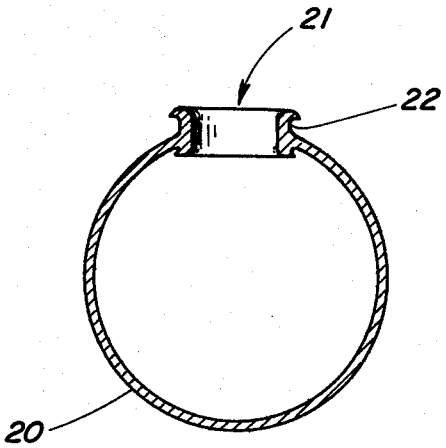
FIG. 1 is a cross-sectional view of a coolant tube having a collared hole produced with the tool and method disclosed herein.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
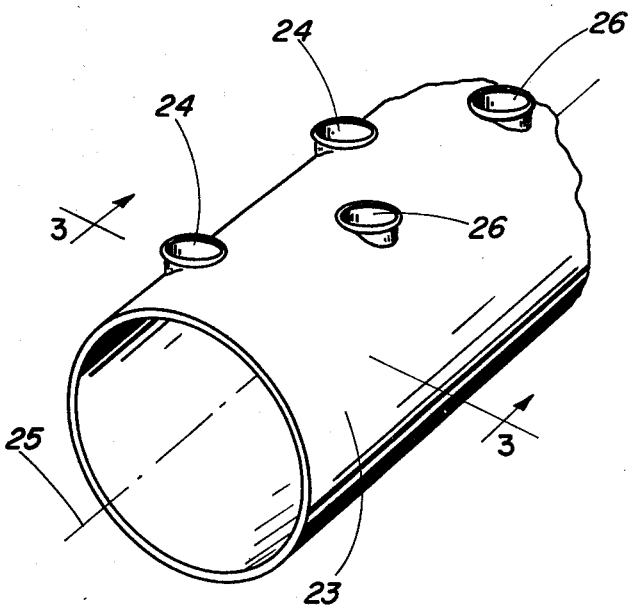
FIG. 2 is a perspective view of a coolant tube having a plurality of collared holes formed off center of the longitudinal axis of the tube.

Referring now more particularly to FIG. 1, there is shown a coolant tube or header 20 having an opening or hole 21 surrounded by collar 22. The collar protrudes internally as well as externally of header 20. Another header 23 is shown in FIG. 2 and is provided with a first group of collars 24 positioned to the left of a vertical plane extending through the center longitudinal axis 25 of header 23. A second group of collars 26 is provided in header 23 being located to the right of a vertical plane passing through the longitudinal center axis 25 shown in FIG. 2.

The smaller diameter coolant tubes inserted into the collared holes shown in FIGS. 1 and 2 have a circular cross section and thus, the holes formed by the collars of FIGS. 1 and 2 must be circular. Hole 21 (FIG. 1) has been drilled or formed with a center axis passing through the center of tube 20 whereas the holes formed by collars 24 and 26 (FIG. 2) each have a center axis which passes, respectively, to the left and right of the center of tube 23 as shown in FIG. 3.

Collars 24 each have a center vertical axis 27 which is parallel to the center axis 28 extending centrally through each collar 26. Collars 24 define a circular hole as viewed looking in the direction of center axis 27 whereas collars 26 define a circular hole looking in the direction of center axis 28. It can be appreciated that when drilling or forming the hole in header 23 prior to the formation of collars 24 and 26, that the holes in the header have an eliptical configuration due to the curvature of header 23 and being offset from the central axis 25 whereas the hole in header 20 has a circular configuration prior to the formation of collar 22.

Figure 3:
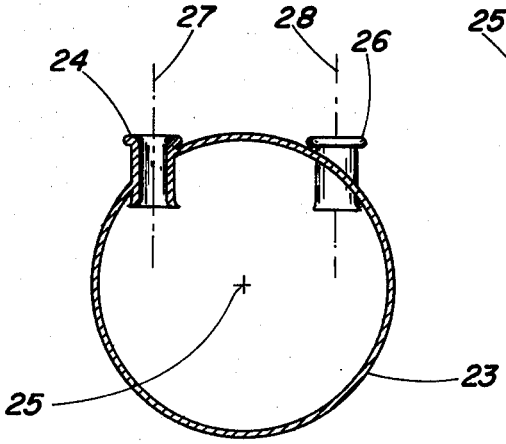
FIG. 3 is a cross-sectional view taken along line 3—3 of FIG. 2 and viewed in the direction of the arrows.
Figure 4:
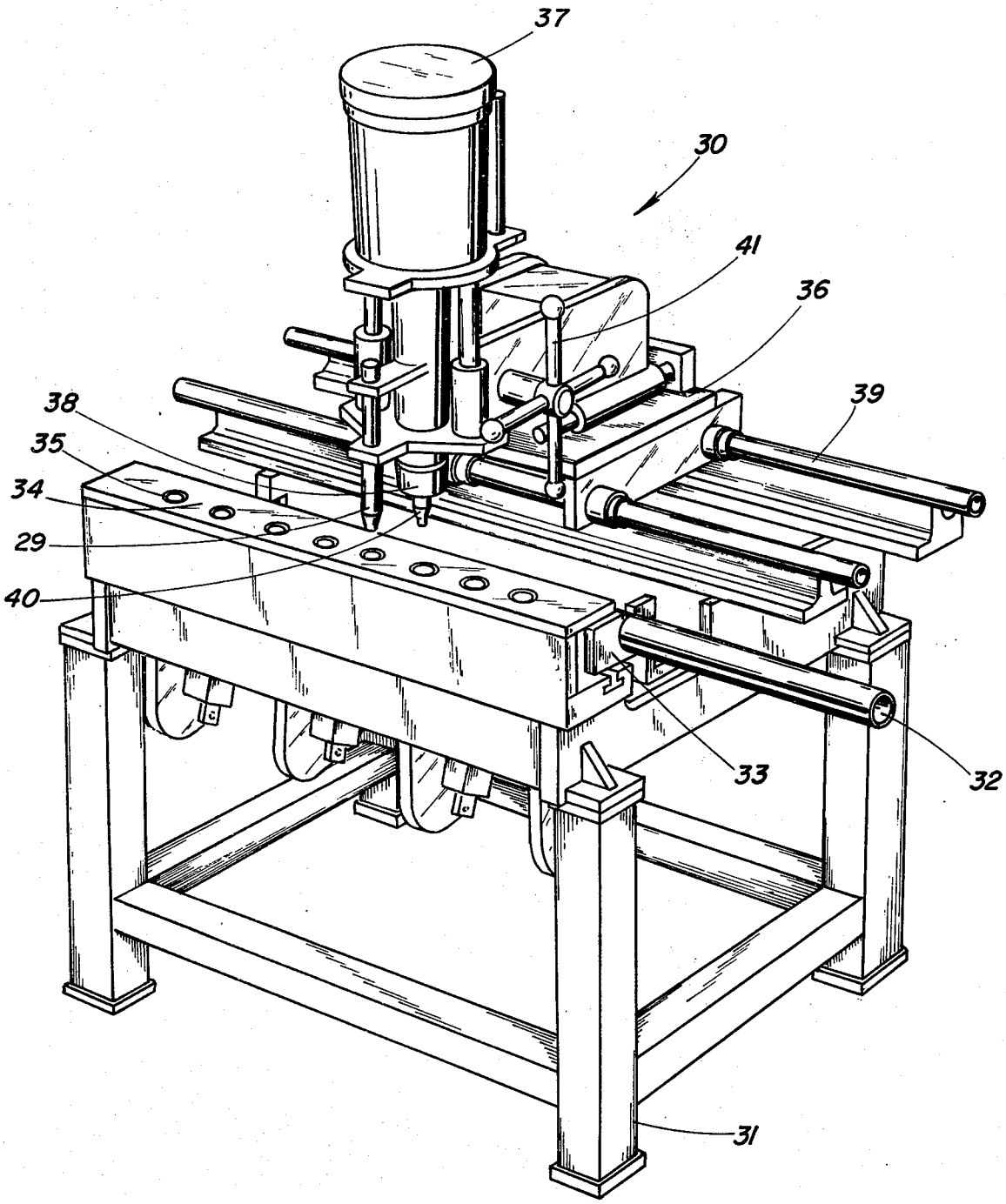
FIG. 4 is a perspective view of a machine for using the tools and methods disclosed herein.
Figure 6:
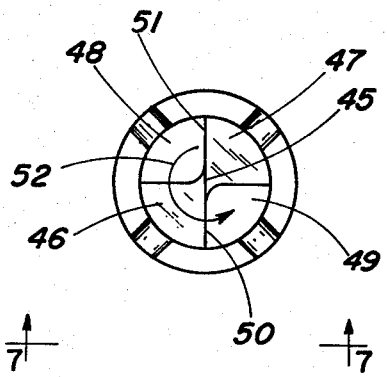
FIG. 6 is an end view of the tool of FIG. 5.

Machine 30 (FIG. 4) is used to form the collared holes shown in FIGS. 1 through 3. Machine 30 includes a conventional frame 31 forming a table to hold the workpiece or conduit 32. A plurality of clamps 33 are mounted atop frame 31 being of conventional design and operated by pneumatic cylinders. The jaws of clamps 33 open to facilitate the insertion and removal of conduit 32. A changeable template 34 is mounted atop frame 31 having a plurality of guide openings 35 positioned to the side of workpiece 32. A locator pilot pin 29 is mounted to carriage 36 along with a powerhead or electric motor 37 having an output shaft operatively engaged with a rotatable chuck 38 which grasps and holds rotating tool bit 40.

Carriage 36 is slidably mounted on a pair of guide rails 39 to allow the carriage to move along the length of workpiece 32. Hand wheel 41 is connected by a suitable gear arrangement to powerhead 37 to control the vertical movement of the rotating tool bit 40. The powerhead is precision mounted on ball bearing slides for smooth and accurate travel in all three planes. The construction employed is conventional in nature and will not be detailed herein. In one embodiment, the powerhead was a five horsepower drive motor having an output shaft driven at 3,450 rpm. Hand wheel 41 controls the initial vertical position of rotating tool bit 40 with the downward movement cycle of tool bit 40 being automatically controlled by suitable circuitry and limit switches.

Initially, the operator places workpiece 32 into clamps 33 and slides the workpiece against an end stop. The clamps are then closed and the operator starts the powerhead 37 to rotate chuck 38 and tool bit 40. The operator moves carriage 36 to a position where the locator pilot 29 is approximately aligned with the appropriate opening 35 in template 34. The operator then turns hand wheel 41 to feed the tool down toward workpiece 32. The locator pilot pin 29 will engage template 34 and positively position the spindle or chuck 38 prior to the tool 40 contacting workpiece 32. Tool 40 will automatically continue downward so as to first form a hole in the wall of workpiece 32 and then form a collar surrounding the hole. At a predetermined position, a suitable limit switch will be tripped causing the spindle to move upwardly and allowing tool 40 to disengage the workpiece 32. In the event that the collared hole is located off center with respect to the longitudinal center axis of the conduit as shown in FIG. 2, then the rotation of chuck 38 and tool 40 will be reversed once the collar has been initially formed with the tool 40 continuing to move downwardly. The tool is then withdrawn and the locator pilot pin is moved to the next appropriate opening 35 in template 34. Tool 40 is positioned immediately over workpiece 32 whereas locator pilot pin 29 is positioned to the side of workpiece 32 so as to engage template 34.

Figure 5:
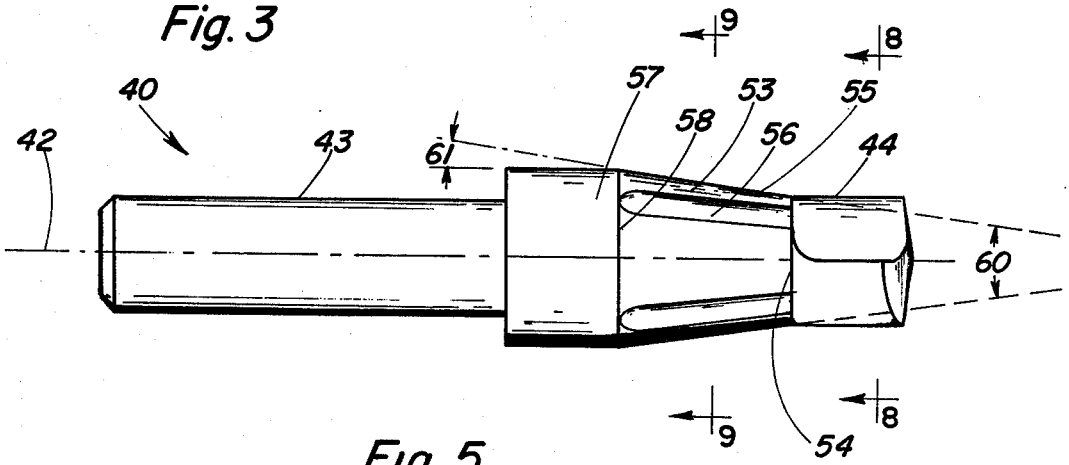
FIG. 5 is an enlarged side view of the preferred embodiment of the tool incorporating the present invention and which is used with the machine of FIG. 4.

The preferred embodiment of the rotating tool bit 40 is shown in FIG. 5. Tool 40 is used to form a collared hole in a workpiece. The workpiece may either be a conduit such as shown in the previous drawings or may be a noncircular workpiece such as a flat piece of material. Tool 40 includes a main body having a longitudinal axis of rotation 42. The proximal end 43 of the main body is rod configured to be inserted into the chuck 38 to facilitate the grasping and rotation of the tool about axis 42. The opposite end 44 of the main body includes means operable to form the hole in the workpiece as the main body is moved through the workpiece. The means 44 shown in FIG. 5 is configured as a drill for drilling the hole in the workpiece.

In the embodiment shown in FIGS. 5–8, the drill includes a pointed end 45 formed by two diagonally oppositely opposing flutes 46 and 47 spaced apart by voids 48 and 49. Flutes 46 and 47 are respectively provided with cutting edges 50 and 51 with the normal rotation of the tool being in the direction of arrow 52 about axis of rotation 42.

Figure 8:
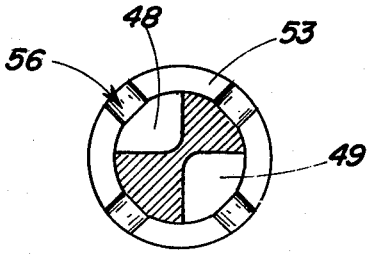
FIG. 8 is a cross-sectional view taken along line 8—8 of FIG. 5 and viewed in the direction of the arrows.
Figure 9:
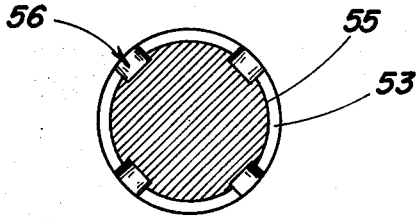
FIG. 9 is a cross-sectional view taken along the line 9—9 of FIG. 5 and viewed in the direction of the arrows.
Figure 7:
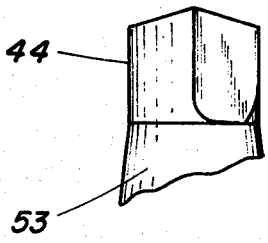
FIG. 7 is a fragmentary side view looking in the direction of arrows 7—7 of FIG. 6.

The drill includes a tapered portion 53 positioned intermediate the drill means 44 and end 43. Tapered portion 53 extends increasingly outward along axis 42 in a direction from means 44 to end 43. Tapered portion 53 is contiguous to and of equal diameter to means 44 at location 54. Tapered portion 53 has a circular diameter as shown in FIGS. 8 and 9 with a smooth outer surface 55 interrupted by a plurality of flats or concave portions 56 spaced equally at 90° intervals about the axis of rotation. Flats 56 extend the length of the tapered portion from means 44 to the constant diametered cylindrically configured portion 57 (FIG. 5). Tapered portion 53 has a truncated conical configuration with the larger diameter portion contiguous to cylindrical portion 57. The embodiment shown in the drawings has four flats positioned equally distant around the axis of rotation; however, it is to be understood that the number of flats may be increased or decreased and that the flats may take the actual configuration of a concave or any number of differently configured depressions. Each flat 56 terminates at location 54 (FIG. 5) and at the opposite end of the tapered portion shown as location 58 (FIG. 5).

In one embodiment, tool 40 had an approximate length of $5\frac{3}{4}$ inches with means 44 having a length of $\frac{3}{4}$ inch and tapered portion 53 having an approximate length of $1\frac{1}{8}$ inches. In the same embodiment, the length of the constant diametered cylindrical portion 57 along axis 42 was $\frac{7}{8}$ inch. In the same embodiment, the diameter of constant diametered portion 57 was 1.177 inches whereas the diameter of means 44 was 0.875 inches. The included angle 60 formed by tapered portion 53 in the embodiment shown in FIG. 5 is 15° and thus, the outer surface 55 is at an angle 61 relative to axis 42 of $7\frac{1}{2}$°. Tapered portion 53 is used to form the collar surrounding the hole formed by means 44 shown in FIGS. 1 and 2. Thus, the included angle 60 must be sufficient to cause interference between the circumference of the hole formed in the workpiece but must not be sufficiently great so as to preclude movement of the tapered portion 53 through the hole in the workpiece. Thus, included angle 60 should be at least 10° and not greater than 40°. Likewise, angle 61 must be at least 5° but not greater than 20°.

The method of forming a collared hole in the workpiece includes the step of forming the hole in the workpiece by means 44, such as a drill. Thus, the workpiece is contacted with a cutting tool which is then rotated about axis 42 with the cutting tool then being forced during the rotation step against the workpiece to form the hole in the workpiece.

After the hole is formed in the workpiece, the tapered tool 53 is inserted into the hole with the outer circumferential surface 55 contacting the circumference of the hole. The tapered tool must be of sufficient size and taper so as to interferingly engage around the complete circumference of the hole except in those places where flats 56 are located. The tapered tool is rotated during the contacting step and forced further into the hole forming a collar, such as collar 22 shown in FIG. 1, which is integral with the workpiece and which surrounds the hole. As the tapered tool is rotated and forced into the hole, the portion of the workpiece surrounding the hole and in contact with the tapered tool is plasticized with the plasticized portion of the workpiece flowing around the tapered tool forming the collar. The tapered tool is forced further through the hole until collar 22 extends on the opposite sides of the workpiece. For example, the tapered tool is forced through the hole resulting in the collar 22 projecting externally and internally relative to workpiece 20. After the collar has been formed, the rotation of tool 40 is continued and tapered portion 53 is pushed completely through the hole in the workpiece until the circular portion 57 of the tool is positioned completely within the collar. Circular portion 57 of the tool is rotated within the collar about axis 42 in order to straighten and polish the internal surface of the collar. The outside diameter of circular portion 57 should not be less than the inside diameter of the collar formed by tapered portion 53. Tool 40 is then withdrawn from the workpiece.

The method and tool disclosed herein may be used to produce collared holes in a variety of metals including aluminum and copper. Excellent results have been obtained by rotating the tapered tool 53 around axis 42 between 3,000 to 4,000 rpm as the collar is formed. Contact between the tapered tool 53 and the circumference of the hole in the workpiece is limited to only a portion of the circumference of tapered tool 53 at any given time due to the presence of flats or depressions 56. With the embodiment of the tool shown in FIG. 5 which is being rotated at approximately 3,500 rpm, a collared hole may be formed in a conduit as shown in FIG. 1 in approximately 2 to 3 seconds. The wall thickness of the conduit shown in FIG. 1 is approximately one-sixteenth of an inch with the outside diameter of the conduit being approximately $2\frac{5}{8}$ inches. The overall height of collar 22 is approximately $\frac{1}{4}$ inch whereas the inside diameter of hole 21 is $1\frac{1}{8}$ inches.

In the event that the collared hole is not located over the central axis of the conduit then an additional step is used to obtain optimum results. For example, the collar holes shown in FIG. 2 are located off center with respect to axis 25. Superior results have been obtained by reversing the rotation of the tapered tool 53 during the rotating step as the tapered tool is forced through the noncircular holes of a conduit wherein the holes are located off center relative to axis 25 as shown more clearly in FIG. 3. Thus, when producing collared holes located off center for conduit 23, the method previously described is identical with the exception that the tapered tool is rotated first in one direction and forced through the hole in the workpiece until the workpiece is located approximately equidistant between the drill means 44 and the circular portion 57. The rotation of the tapered drill is then immediately reversed and the tapered drill is continually forced through the workpiece until the cylindrical portion 57 has completely polished and straightened the inside surface of the collar. Tool 40 is then completely withdrawn from the workpiece and the rotation reversed so as to drill the next hole in the workpiece and initially form the collar surrounding the hole as previously described.

Figure 10:
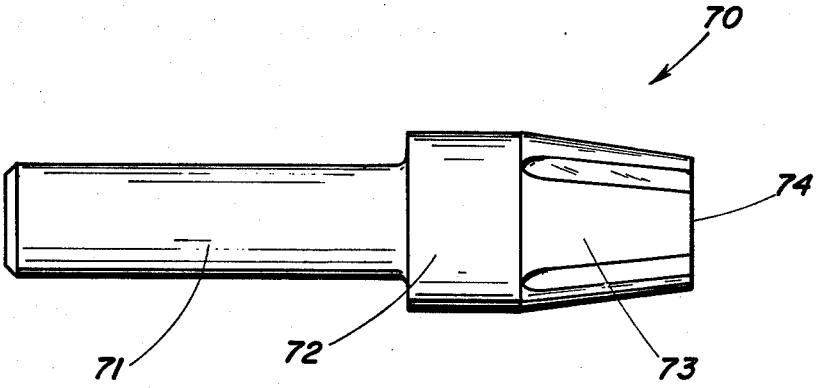
FIG. 10 is a side view of an alternate embodiment of the tool shown in FIG. 5 on a reduced scale.

An alternate embodiment of tool 40 is shown in FIG. 10. Tool 70 is identical in every respect to tool 40 with the exception that the drill means 44 is absent from tool 40. Thus, portions 71, 72 and 73 of tool 70 are identical relative to portions 43, 57 and 53 of tool 40. Likewise tool 70 is used according to the method previously described for tool 40 with the exception that the hole in the workpiece is initially formed by a separate conventional tool or drill not shown. After the hole is initially formed in the workpiece, then end 74 of tool 70 is inserted into the hole and the collar is formed in the manner previously described. A suitable tool 70 is provided by having the dimensions and angles of portions 71, 72 and 73 being identical with the dimensions and angles previously described for portions 43, 57 and 53 of tool 40. While many variations in the size of the collar are possible to produce with the method and tool disclosed herein, the collar shown in FIG. 1 extended an equal length into the conduit as compared to the length extending externally of the conduit.

Figure 11:
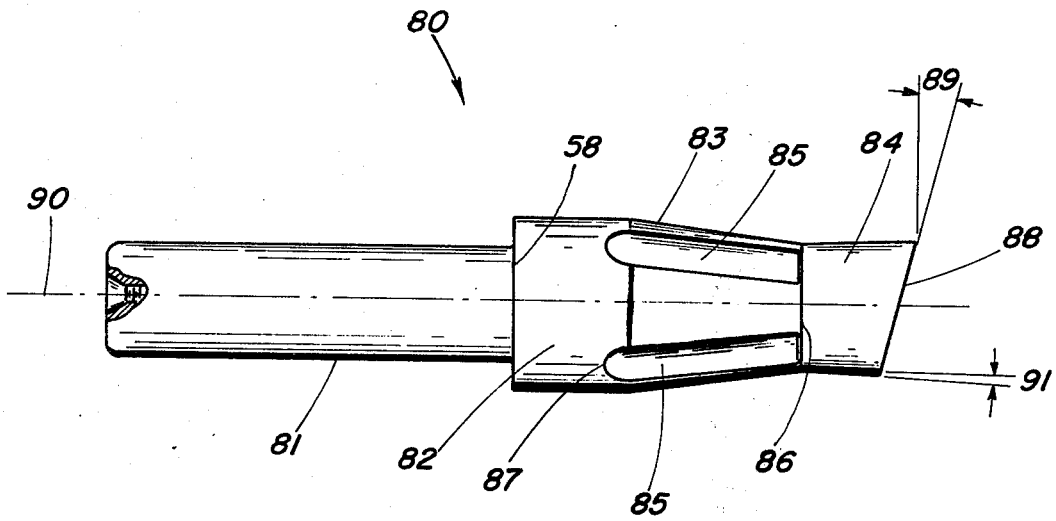
FIG. 11 is a side view of a further embodiment of the tool shown in FIG. 5 on a reduced scale.
Figure 12:
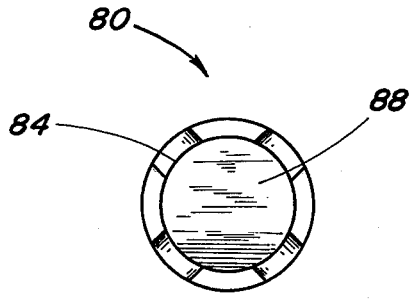
FIG. 12 is an end view of the tool of FIG. 11.

A further embodiment of the tool is shown in FIG. 11 with the end view of the tool being shown in FIG. 12. Tool 80 is identical with respect to tool 40 previously described and illustrated with the exception that the means used to initially form the hole in the workpiece is different. Thus, portions 81, 82 and 83 of tool 80 are identical with the portions 43, 57 and 53 of tool 40. Flats 85 are identical with respect to the flats 56 of tool 40 with the exception that flats 85 extend into the cylindrical portion 82. In lieu of a two-fluted drill tip such as shown for tool 40, a flat beveled tool tip is provided for tool 80. Means 84 is used to initially form the hole in the workpiece prior to the formation of the collar which extends around the hole. Means 84 is cylindrical in configuration and is integrally joined to tapered portion 83 along boundary 86. Means 84 increases slighty in diameter from boundary 86 to the opposite end 88 of means 84 which is beveled forming a flat surface 88 at an angle 89 of 15° formed with a line perpendicular to the axis of rotation 90.

In one embodiment of tool 80, the tool has a complete length of 5½ inches with portion 81 having a length of 2⅛ inches and means 84 having a length of 0.625 inches. In the same embodiment, the diameter of means 84 at boundary 86 was 0.860 inches. The outside cylindrical surface of means 84 is at an angle 91 of ½° formed with respect to a line parallel to axis 90.

Tool 80 is used in the manner and method identical to that previously described for tool 40. Thus, the hole in the workpiece is initially formed by rotating tool 80 about axis 90 and forcing the beveled end 88 of means 84 through the workpiece so as to form the hole with the collar then being subsequently formed by the tapered portion 83 and cylindrical portion 82. Means 84 of tool 80 increases in diameter toward the tip of the tool in order to provide suitable relief to prevent tool chatter.

It will be obvious from the above description that the present invention provides a new and improved method and tool for providing or forming a collared hole in a workpiece. In addition, the collared hole is new and novel as compared with prior collared holes in that the collars disclosed herein project internally and externally of a conduit and further may be located off center with respect to the central axis of the conduit. A further improvement is the projection of the collar through the opposite sides of a workpiece while being integral therewith.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

The invention claimed is:

1. A method of forming a collared hole comprising the steps of:

forming a hole in a workpiece;

inserting a tapered tool into said hole wherein said tool is of sufficient size and taper to interferingly engage said workpiece at said hole;

contacting said tapered tool against said workpiece around the perimeter of said hole;

rotating said tapered tool during said contacting step;

forcing said tapered tool further through said hole during said rotating step forming a collar integral with said workpiece around said hole;

withdrawing said tapered tool from said hole; and reversing the rotation of said tapered tool during said rotating step when said hole in said workpiece is noncircular.

2. A method for forming a collar around a hole in a workpiece comprising:

inserting a tapered tool into said hole wherein said tool is of sufficient size and taper to interferingly engage said workpiece at said hole;

contacting said tapered tool against said workpiece around the perimeter of said hole;

rotating said tapered tool in a first direction during said contacting step;

reversing the rotation of said tapered tool during said rotating step when said hole in said workpiece is noncircular;

forcing said tapered tool through said hole during said rotating step and reversing step forming a collar integral with said workpiece around said hole and wherein said collar has an internal circular cross section; and withdrawing said tool from said hole.

3. The method of claim 2 wherein said hole is formed on a curved portion of said workpiece.

* * * * *

UNITED STATES PATENT AND TRADEMARK OFFICE

CERTIFICATE OF CORRECTION

PATENT NO. : 4,132,097

DATED : January 2, 1979

INVENTOR(S) : Ward A. Ames

It is certified that error appears in the above-identified patent and that said Letters Patent are hereby corrected as shown below:

In column 7, line 2, please change "2-1/8" to "2-5/8".

Signed and Sealed this

*Third* Day of *April 1979*

[SEAL]

*Attest:*

RUTH C. MASON
*Attesting Officer*

DONALD W. BANNER
*Commissioner of Patents and Trademarks*